US008167436B2

(12) United States Patent
Ikeda et al.

(10) Patent No.: US 8,167,436 B2
(45) **Date of Patent: *May 1, 2012**

(54) DISPLAY SHELF WITH PLACING TABLES AND TRANSMISSION-TYPE SCREENS HAVING PROJECTING PARTS AND LATERALLY-FACING DISPLAYS

(75) Inventors: Yoshihiko Ikeda, Shizuoka (JP); Hiroki Mochizuki, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/094,784

(22) Filed: Apr. 26, 2011

(65) Prior Publication Data

US 2011/0199585 A1 Aug. 18, 2011

Related U.S. Application Data

(62) Division of application No. 12/070,696, filed on Feb. 20, 2008, now Pat. No. 7,954,958.

(30) Foreign Application Priority Data

Feb. 23, 2007 (JP) ..... 2007-043505

(51) Int. Cl.
*G03B 21/22* (2006.01)

(52) U.S. Cl. ..... 353/74; 353/78; 359/449; 359/460

(58) Field of Classification Search ..... 353/28, 353/74, 77, 78; 359/499, 449, 460, 900; 211/153; 340/572.1

See application file for complete search history.

(56) References Cited

U.S. PATENT DOCUMENTS

| | | | | |
|---|---|---|---|---|
| 5,708,528 | A | 1/1998 | Furuya | |
| 7,798,652 | B2 | 9/2010 | Ikeda et al. | |
| 7,832,874 | B2 | 11/2010 | Ikeda et al. | |
| 7,954,958 | B2 * | 6/2011 | Ikeda et al. | 353/74 |
| 2005/0012995 | A1 | 1/2005 | Chang | |
| 2005/0168707 | A1 | 8/2005 | Feldpausch et al. | |
| 2008/0151197 | A1 | 6/2008 | Mochizuki et al. | |

FOREIGN PATENT DOCUMENTS

| | | |
|---|---|---|
| DE | 20 2004 003 242 | 6/2004 |
| DE | 20 2006 004 645 | 7/2006 |
| EP | 1837843 | 9/2007 |
| JP | 07-017608 | 1/1995 |
| JP | 07-231838 | 9/1995 |
| JP | 09-311381 | 12/1997 |
| JP | 2001-245756 | 9/2001 |

(Continued)

OTHER PUBLICATIONS

English Translation of Japanese Office Action dated Jan. 8, 2009.

(Continued)

*Primary Examiner* — Francis M Legasse, Jr.
(74) *Attorney, Agent, or Firm* — Patterson & Sheridan, LLP

(57) ABSTRACT

A display shelf system includes a display shelf, which includes a plurality of placing tables which are adapted to have an article placed thereon. A plurality of transmission-type screens are arranged with the placing tables, respectively. A projector projects a projector image, and a light guide of the display shelf leads the projector image onto the rear sides of the transmission-type screens. The transmission-type screens have curved surfaces which are inclined to face toward a lateral direction with respect to a front of the display shelf, so that the transmission-type screens are easily viewable by viewers who are in the lateral directions of the display shelf.

10 Claims, 8 Drawing Sheets

FOREIGN PATENT DOCUMENTS

| | | |
|---|---|---|
| JP | 2005-099888 | 4/2005 |
| JP | 2006-047890 | 2/2006 |
| WO | WO-02/054918 | 7/2002 |

OTHER PUBLICATIONS

English Machine Translation of JP 09-311381.

Chinese Office Action dated Aug. 21, 2009 and English Translation thereof issued in counterpart Chinese Application No. 2008100740778.

Japanese Office Action dated Nov. 18, 2008 (and English Translation thereof) issued in a counterpart Japanese Application.

A Display Shelf for Display, Nikkei Industrial Newspaper, Compact Edition, Japan, Nikkei Inc., Sep. 29, 2006, front page (Japanese Language and Partial English Translation thereof).

Extended European Search Report dated May 27, 2008, issued in counterpart European Application.

* cited by examiner

DISPLAY SHELF WITH PLACING TABLES AND TRANSMISSION-TYPE SCREENS HAVING PROJECTING PARTS AND LATERALLY-FACING DISPLAYS

CROSS REFERENCE TO RELATED APPLICATION

The present application is a divisional of U.S. patent application Ser. No. 12/070,696, filed Feb. 20, 2008, which is based on and claims the benefit of priority of Japanese Patent Application No. 2007-043505 filed on Feb. 23, 2007, the entire contents of which are incorporated herein by reference.

BACKGROUND OF THE INVENTION

1. Field of the Invention

The present invention relates to a display shelf and a display shelf system, and particularly, to a display shelf and a display shelf system having a transmission-type screen, and a projector which is capable of projecting a projector image on the basis of input data.

2. Discussion of the Background

A display shelf is used widely in retail shops, such as supermarkets, convenience stores, and department stores. In such retail shops, an article is displayed on the display shelf, and an inventory tag corresponding to the article is set in the display shelf for the purpose of giving information about a price of the article and so on to customers.

In recent years, an electric inventory tag has been developed (see Japanese Laid-Open Publication No. 2005-099888 and Japanese Laid-Open Publication No. Hei 7(1995)-17608). The electric inventory tag uses, for example, a liquid crystal panel or an organic EL panel (see paragraph [0008] of Japanese Laid-Open Publication No. 2005-099888).

Moreover, POP (Point-of-Purchase) advertising is used widely as a method for promoting the purchase of an article by bringing the article displayed on the display shelf to customers' attention. Japanese Laid-Open Publication No. 2001-245756 discloses a showcase (display shelf) which includes a projector and a transmission-type screen for displaying an image projected from the projector, on a ceiling of the showcase. This technique eliminates the need for attaching a POP advertisement made from a recording medium, such as paper, to the display shelf. Furthermore, the display effect of an article displayed on the display shelf can be enhanced by projecting a projector image on the screen (see paragraph [0018] of Japanese Laid-Open Publication No. 2001-245756).

Japanese Laid-Open Publication No. 2005-099888 and Japanese Laid-Open Publication No. Hei 7(1995)-17608 disclose a display shelf that displays a price or advertising on a flat display surface. Such a display surface is easily viewable when seen head-on. However, such a display surface is not easily viewable seen from the side (from a lateral direction of the display surface). Therefore, such a display surface is not easily viewable by a viewer approaching the display shelf from the side (from the lateral direction). Depending on the layout of the display shelf, many viewers may be positioned in the lateral direction (to the side) of the display shelf.

SUMMARY OF THE INVENTION

It is one object of the present invention to provide a display shelf that has an appealing effect and that is easily viewable from the lateral direction of the display shelf.

According to the present invention, a display shelf includes: (i) a placing table adapted to have an article placed thereon, (ii) a projector placing portion which is adapted to support a projector, (iii) a transmission-type screen which is arranged with the placing table, and which includes a laterally-facing display which is inclined to face toward a lateral direction with respect to a front of the display shelf, and (iv) a light guide adapted to lead a projector image from the projector onto a rear side of the transmission-type screen.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE INVENTION

An embodiment of a display shelf according to the present invention is described below with reference to FIGS. 1 through 7. The embodiment of the present invention described below relates to a display shelf system which is preferably used in a supermarket.

Figure 1:
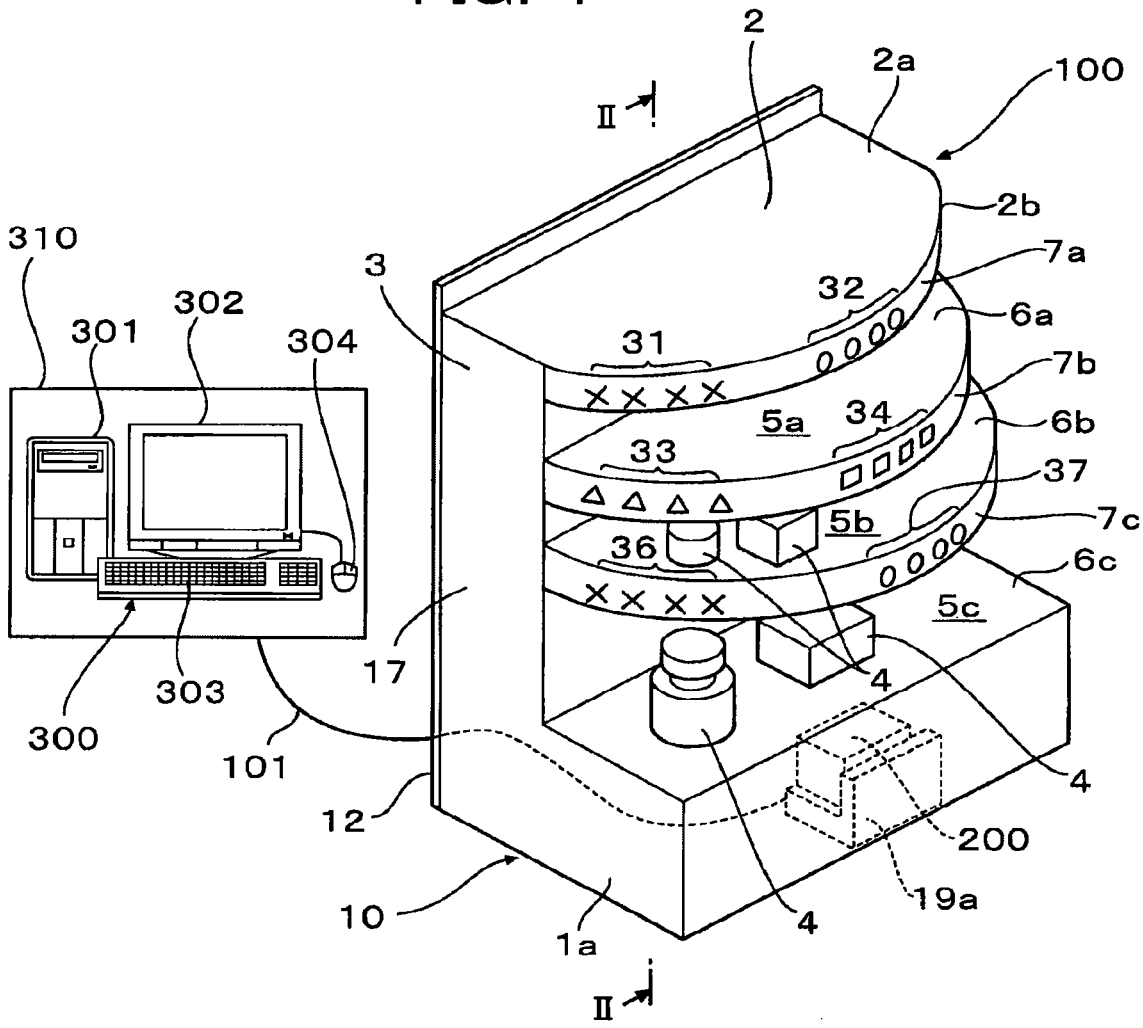
FIG. 1 is an exemplary diagram of a display shelf system according to an embodiment of the present invention.

As shown in FIG. 1, a display shelf system 100 includes a display shelf 10 located in a store, a projector 200 located inside of the display shelf 10, and a computer 300, which is located away from the display shelf 10, for example in a stock room or back room 310 or another area away from the sales floor the store. The computer 300 serves as a control terminal, which is capable of controlling an image display of the display shelf 10. The computer 300 is connected to the projector 200 via a line 101.

The display shelf 10 includes a housing 1*a* shaped like a chassis having an upper placing table 6*a*, a middle placing table 6*b*, and a lower placing table 6*c*, arranged one above the other, each of which is adapted to have an article (or articles) placed thereon. Placing spaces 5*a*, 5*b*, and 5*c* are formed above the three placing tables 6*a*, 6*b*, and 6*c*, respectively. The placing tables 6*a*, 6*b*, and 6*c* are sandwiched between and horizontally supported by a pair of side panels 3 of the housing 1.

Figure 2:
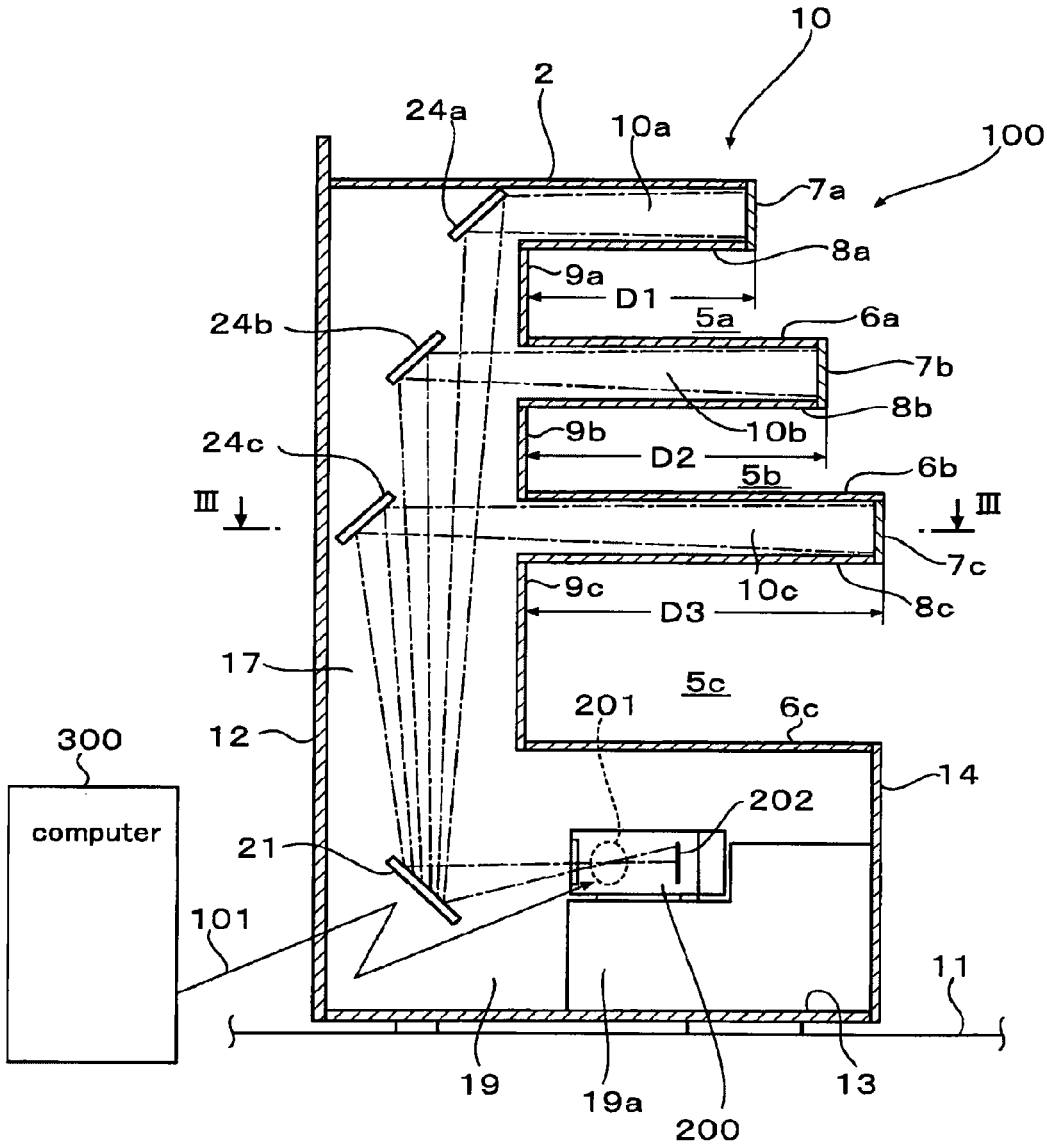
FIG. 2 is a cross-sectional view along line II-II in FIG. 1.
Figure 3:
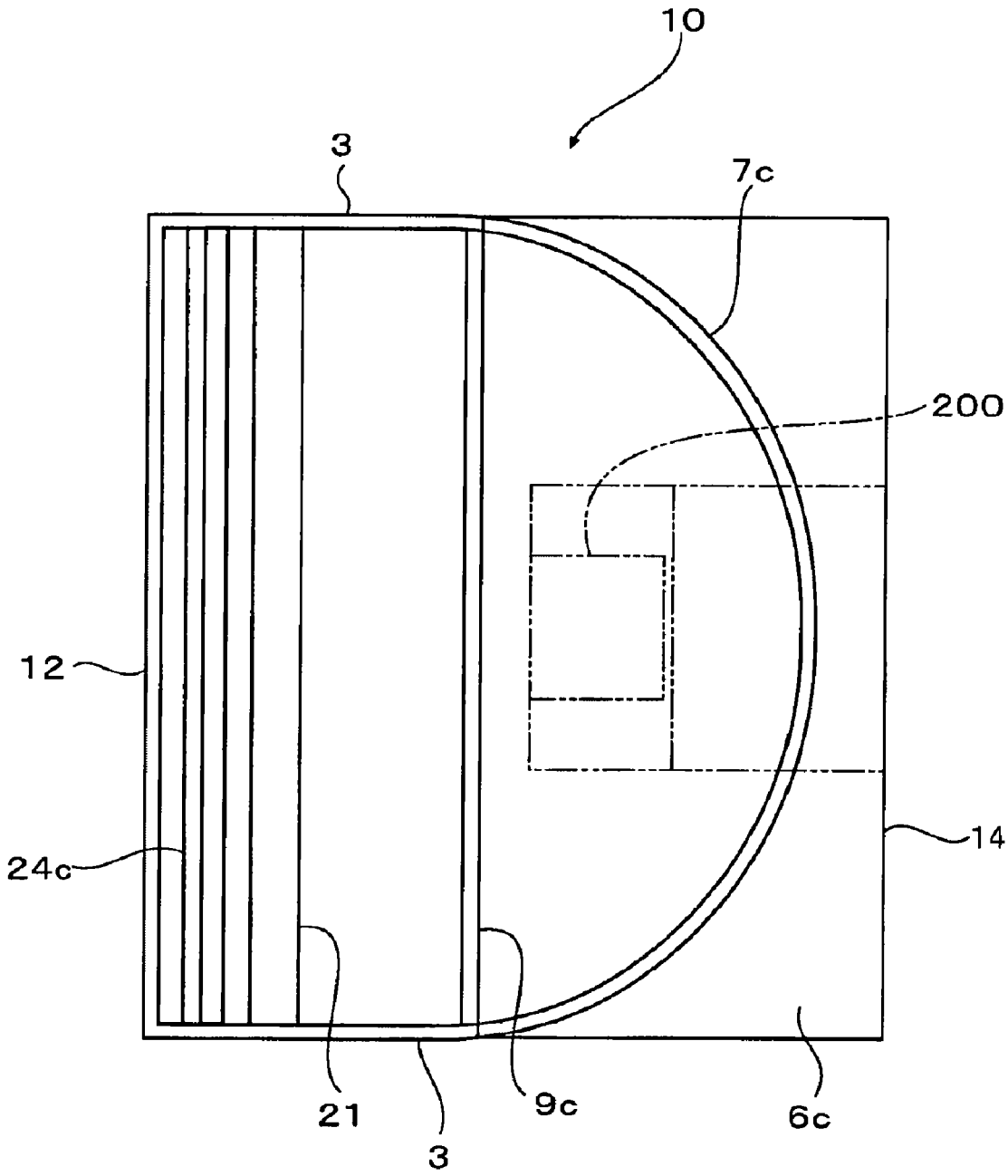
FIG. 3 is a cross-sectional view along line III-III in FIG. 2.

Furthermore, as shown in FIG. 2, the housing 1*a* includes a top panel 2, a back panel 12, a bottom panel 13, and a lower front panel 14, as well as ceiling panels 8*a*, 8*b*, and 8*c*, and deep-set panels 9*a*, 9*b* and 9*c*.

The top panel 2 is sandwiched between and horizontally supported by the side panels 3, and covers the top of the display shelf 10. As shown in FIG. 1, the top panel 2 includes a rectangular posterior region 2*a* and an anterior region 2*b* that has an anterior edge which is formed in an arc (is arc-shaped). Thus, the top panel 2 has an approximately semicircular configuration such that the central region thereof extends forward farther than the sides thereof.

The back panel 12 is sandwiched between the side panels 3 and is positioned vertically at the back side of the display shelf 10. The lower edge of the back panel 12 contacts a floor surface 11. The upper edge of the back panel 12 is connected with the top panel 2.

The lower front panel 14 is sandwiched between the side panels 3 and is positioned vertically at the lower front side of the display shelf 10. The lower edge of the lower front panel 14 contacts the floor surface 11.

Each of upper placing table 6*a* and the middle placing table 6*b* has approximately semicircular configuration such that the central region thereof extends forward farther than the sides thereof. The anterior edge of each of the upper placing table 6*a* and middle placing table 6*b* is formed in an arc, in the same manner as the anterior edge of the top panel 2.

The lower placing table 6*c* has a rectangular configuration. The anterior edge of the lower placing table 6*c* connects with the upper edge of the lower front panel 14 and is parallel to the back panel 12.

As shown in FIG. 2, the ceiling panels 8*a*, 8*b*, and 8*c* are disposed above the placing spaces 5*a*, 5*b*, and 5*c*, respectively, and the deep-set panels 9*a*, 9*b*, and 9*c* are disposed at the deep-set (rear) sides of the placing spaces 5*a*, 5*b*, and 5*c*, respectively.

The top panel 2 extends from the deep-set panel 9*a* by a length "D1". The upper placing table 6*a* extends from the deep-set panel 9*b* by a length "D2". And the middle placing table 6*b* extends from the deep-set panel 9*c* by a length "D3". The relationship of the lengths D1, D2, and D3 is as D1<D2<D3 (see FIG. 2). Moreover, the lower placing table 6*c* extends from the deep-set panel 9*c* by a length that is equal to the extending length "D3" of the middle placing table 6*b*. The lengths D1, D2 and D3 are measured from the positions of the deep-set panels 9*a*, 9*b* and 9*c* to the anterior-most portion of the anterior edges of the top panel 2, the upper placing table 6*a* and the middle placing table 6*b*, respectively. The extending length of the lower placing table 6*c* from the deep-set panel 9*c* is measured from the deep-set panel 9*c* to the anterior edge of the lower placing table 6*c*.

The display shelf 10 has an upper screen 7*a*, a middle screen 7*b*, and a lower screen 7*c*, which are positioned at the front of the display shelf 10. The screens 7*a*, 7*b*, and 7*c* are arranged one above the other. More specifically, the upper screen 7*a* is arranged with and disposed above the upper placing table 6*a*. The upper screen 7*a* extends vertically downward from the arc-shaped anterior edge of the top panel 2. The middle screen 7*b* is arranged with and disposed above the middle placing table 6*b*. The middle screen 7*b* extends vertically downward from the arc-shaped anterior edge of the upper placing table 6*a*. The lower screen 7*c* is arranged with and disposed above the lower placing table 6*c*. The lower screen 7*c* extends vertically downward from the arc-shaped anterior edge of the middle placing table 6*b*.

The two sides of each of the screens 7*a*, 7*b*, and 7*c* reach the side panels 3, respectively. Thus, each of the screens 7*a*, 7*b*, and 7*c* is formed in an arc shape, such that the central region (a projecting part) thereof extends farther ahead (toward the front of the display shelf) than the sides thereof. Therefore, each of the screens 7*a*, 7*b*, and 7*c* includes a laterally-facing display on each side of the screen. Each laterally-facing display of each screen has a curved surface and is inclined to face toward a lateral direction with respect to a front of the display shelf 10 (i.e., to face toward a sides, or lateral direction, of the display shelf).

The upper screen 7*a*, the middle screen 7*b*, and the lower screen 7*c* are transmission-type screens, which are capable of transmitting a projector image projected onto the rear face of the screen to the front face of the screen and displaying the projector image. The screens 7*a*, 7*b*, and 7*c* are, for example, made from a synthetic resin such as polycarbonate.

A lower apace 19 for placing a projector 200 is formed inside the display shelf between the side panels 3. The lower space 19 is shaped like, for example, a rectangular-parallelepiped. A projector placing portion 19*a* for supporting the projector 200 is located inside the lower space 19, and the projector 200 is supported by the projector placing portion 19*a*. The projector 200 is, for example, a liquid crystal projector which is capable of projecting a projector image from a liquid crystal panel 202 via a lens 201.

A vertical space 17, which communicates with the lower space 19, is provided at the rear of the inside of the display shelf 10, at the rear side of the lower space 19, and extends vertically upward in the display shelf 10. A main mirror 21 is disposed in the vertical space 17 for reflecting the projector image, projected by the projector 200, upward. Furthermore, a mirror 24*a*, a mirror 24*b*, and a mirror 24*c* are placed in the vertical space 17 to reflect respective portions of the projector image, which has been reflected upward by the main mirror 21, toward the three screens 7*a*, 7*b*, and 7*c*. That is, the mirror 24*c* reflects a portion of the projector image to the screen 7*c*; the mirror 24*b* reflects a portion of the projector image to the screen 7*b*; and the mirror 24*a* reflects a portion of the projector image to the screen 7*a*. Each of the mirrors 21, 24*a*, 24*b*, and 24*c* is a flat mirror having a mirror surface disposed on one side thereof.

Three tiered horizontal spaces 10*a*, 10*b*, and 10*c*, which communicate with the vertical space 17, are provided inside the display shelf 10 in front of the vertical space 17. The upper screen 7*a* is arranged at an end of the horizontal space 10*a*. The horizontal space 10*a* is sandwiched between the ceiling panel 8*a* and the top panel 2 so as to guide the portion of the projector image reflected by the mirror 24*a* toward the upper screen 7*a*. The middle screen 7*b* is arranged at an end of the horizontal space 10*b*. The horizontal space 10*b* is sandwiched between the ceiling panel 8*b* and the upper placing table 6*a* so as to guide the portion of the projector image reflected by the mirror 24*b* toward the middle screen 7*b*. Thus, the upper placing table 6*a* defines a portion (specifically, one side) of the horizontal space 10*b*.

The lower screen 7*c* is arranged at an end of the horizontal space 10*c*. The horizontal space 10*c* is sandwiched between the ceiling panel 8*c* and the middle placing table 6*b* so as to guide the portion of the projector image reflected by the mirror 24*c* toward the lower screen 7*c*. Thus, the middle placing table 6*b* defines a portion (specifically, one side) of the horizontal space 10*c*.

Thus, the housing 1*a* forms a space, which includes the lower space 19, the vertical space 17, and the plurality of tiered horizontal spaces 10*a*, 10*b*, and 10*c*, for leading the projector image projected from the projector 200.

The main mirror 21, the mirror 24*a*, the mirror 24*b*, and the mirror 24*c* constitute an optical system, which is adapted to reflect the projector image projected from the projector 200 toward the rear side of each of the screens 7*a*, 7*b*, and 7*c*.

The main mirror 21 is located at the bottom of the vertical space 17 and is disposed at a level of the lens 201 of the projector 200. The main mirror 21 is angled to reflect the projector image, which is projected horizontally backward in the display shelf 10 from the projector 200, vertically upward. Thus, the projector image projected from the projector 200 will be reflected by the main mirror 21 and will be guided vertically upward in the vertical space 17.

The mirror 24*a* is disposed at a level of the horizontal space 10*a*, and the level of the top of the mirror 24*a* is same as the level of the top of the upper screen 7*a*. The mirror 24*a* is arranged at a predetermined angle so as to reflect a portion of the projector image, which has been reflected by the main mirror 21, toward the rear side of the upper screen 7*a*.

The mirror 24*b* is disposed at a level of the horizontal space 10*b*, and the level of the top of the mirror 24*b* is same as the level of the top of the middle screen 7*b*. The mirror 24*b* is arranged at a predetermined angle so as to reflect a portion of the projector image, which has been reflected by the main mirror 21, toward the rear side of the middle screen 7*b*.

The mirror 24*c* is disposed at a level of the horizontal space 10*c*, and the level of the top of the mirror 24*c* is same as the level of the top of the lower screen 7*c*. The mirror 24*c* is arranged at a predetermined angle so as to reflect a portion of the projector image, which has been reflected by the main mirror 21, toward the rear side of the lower screen 7*c*.

The mirrors 24*a*, 24*b*, and 24*c* are arranged at different positions with respect to each other in a rear-to-front direction of the display shelf 10, such that the mirror 24*c* does not block the portions of the projector image intended for the mirrors 24*a* and 24*b*, and such that the mirror 24*b* does not block the portion of the projector image intended for the mirror 24*a*.

Together, the housing 1*a* and the optical system (mirrors 21, 24*a*, 24*b*, 24*c*) constitute a light guide which is adapted to lead the projector image projected from the projector 200 onto the rear sides of the screens 7*a*, 7*b*, and 7*c*.

The projector 200 is adapted to project a projector image based on image data generated by the computer 300. The computer 300 includes a tower 301, a display 302, a keyboard 303, and a pointing device 304 such as a mouse.

Figure 5:
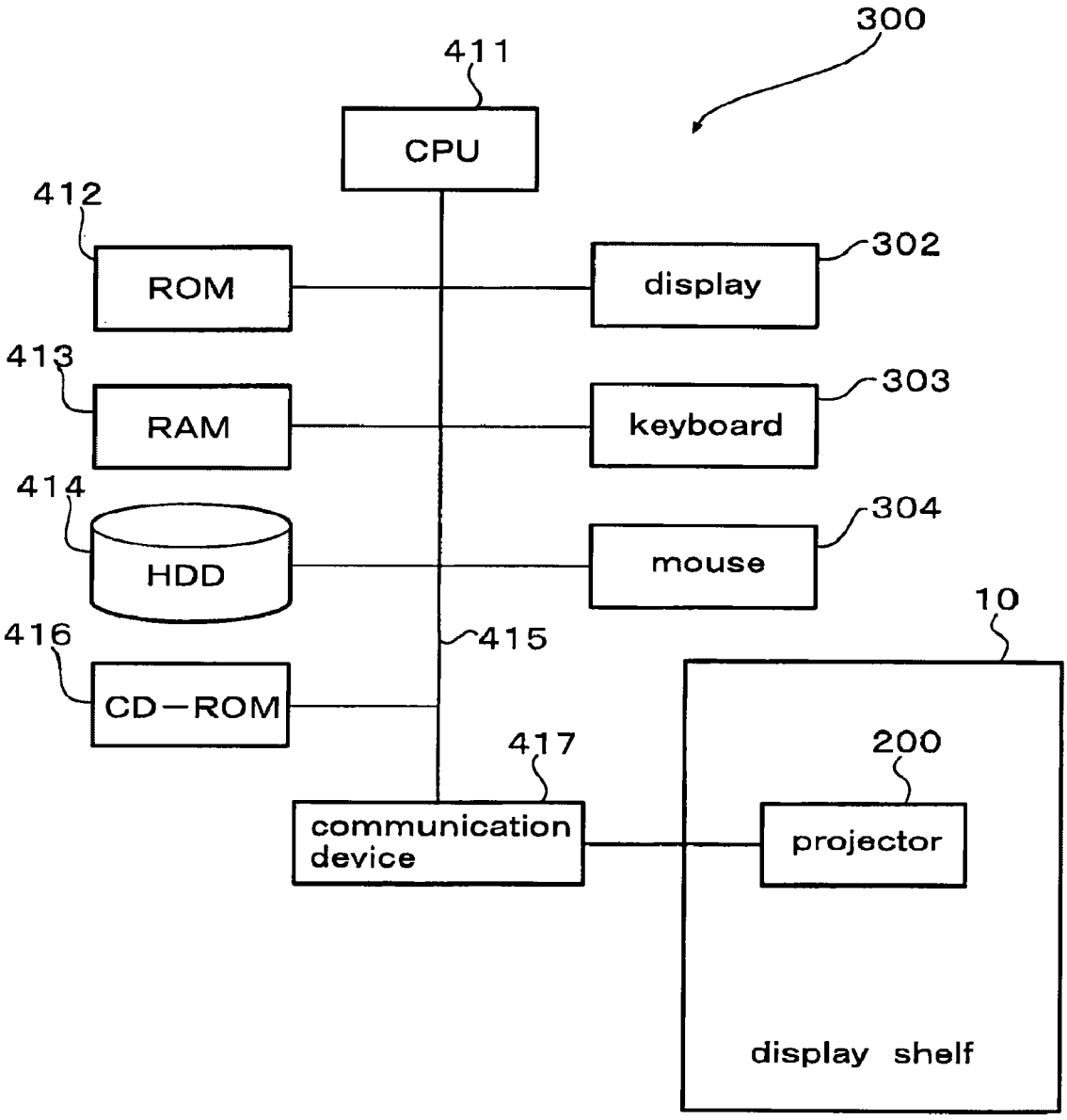
FIG. 5 is a block diagram showing an electrical configuration of a display shelf system according to an embodiment of the present invention.

As shown in FIG. 5, the computer 300 has a CPU 411, which executes a processing program. A ROM 412, a RAM 413, and a HDD 414 are connected to the CPU 411 through a bus line 415. The ROM 412 stores fixed data. The RAM 413 stores the processing program temporarily and serves as a work area of the CPU 411. The HDD 414 stores an OS, the processing program, a contents database 420 (see FIG. 6), and so on. Furthermore, a CD-ROM drive 416, the display 302, the keyboard 303, and the mouse 304 are connected to the bus line 415 via interfaces (not shown). Moreover, a communication device 417 is connected to the bus line 415, and the projector 200 is connected to the communication device 417 via the line 101.

Figure 6:
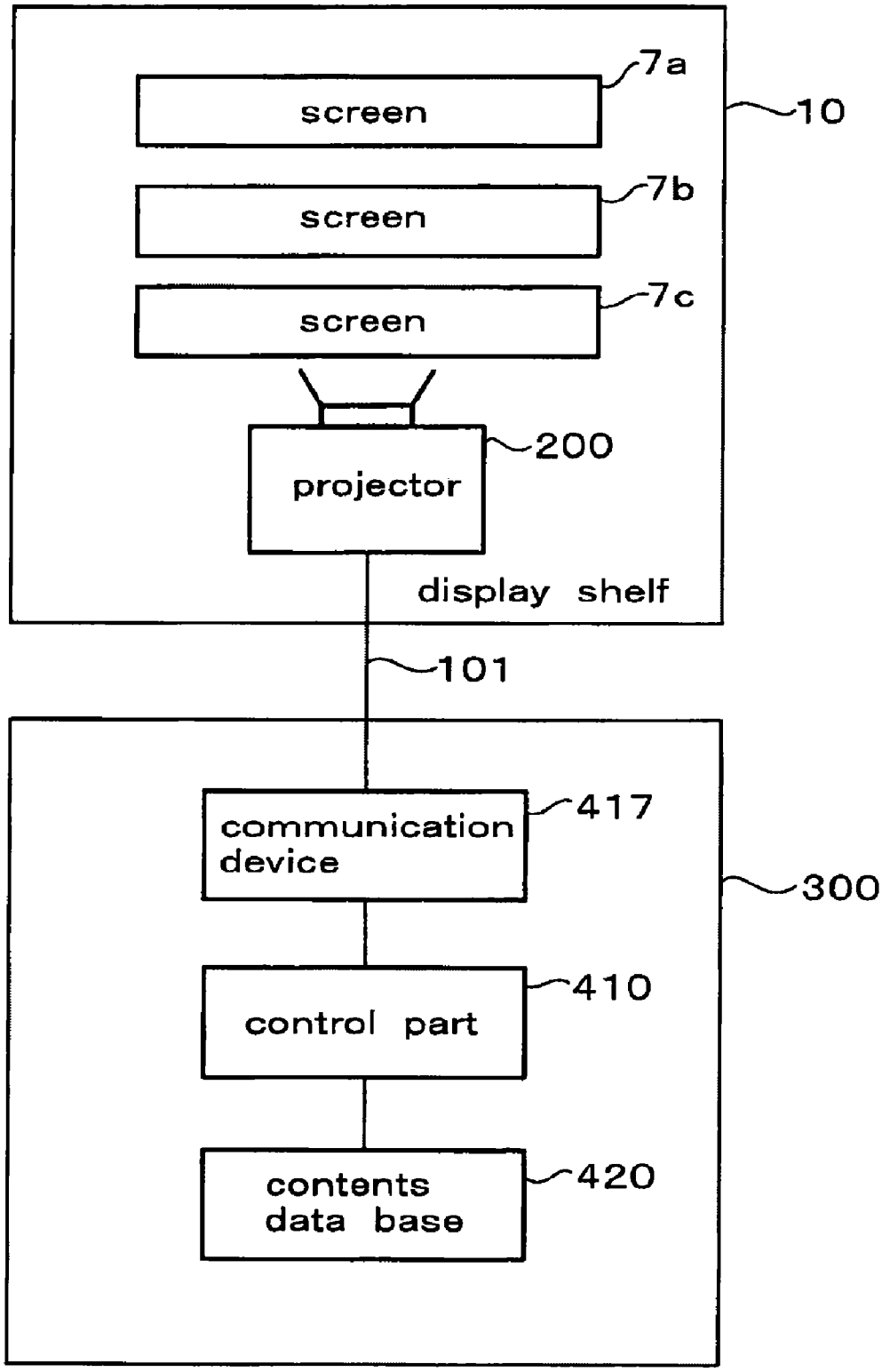
FIG. 6 is a functional block diagram of a display shelf system according to an embodiment of the present invention.

From a functional standpoint, it can be said that the computer 300 includes: the contents database 420 for storing the contents data; a control part 410 for generating image data for the projector image, on the basis of the contents data; and the communication device 417 for transmitting the image data to the projector 200 (see FIG. 6).

The contents database 420 includes contents data related to merchandise information, such as a name, a price, and so on, of articles 4 to be displayed. For example, the contents data can be made by operating the keyboard 303 or the mouse 304 while observing the image displayed on the display 302 (that is, by an operator operating the computer 300). Alternatively, or additionally, the contents data can be provided by a maker of the article 4.

The CPU 411 of the computer 300 executes image editing software in response to operation of the keyboard 303 and/or mouse 304, and generates the image data for the projector image. An image related to the image data is displayed on the display 302. The image displayed on the display 302 is the same as the image to be projected from the projector 200 as the projector image. The image data generated by the computer 300 is transmitted to the projector 200 via the line 101 and stored in an image memory in the projector 200. The image related to the image data stored in the image memory is projected from the projector 200 as the projector image.

The projector image projected from the projector 200 is separated and guided to the rear surfaces of the screens 7*a*, 7*b*, and 7*c* by the main mirror 21 and the mirrors 24*a*, 24*b*, and 24*c*.

Although the separated portions of the projector image do not focus precisely on the screens 7*a*, 7*b*, and 7*c* because the screens 7*a*, 7*b*, and 7*c* have arc shapes, it is possible to display the separated portions of the projector image as viewable images if the screens 7*a*, 7*b*, and 7*c* are arranged within the range of the focal depth of the projector 200.

Figure 4:
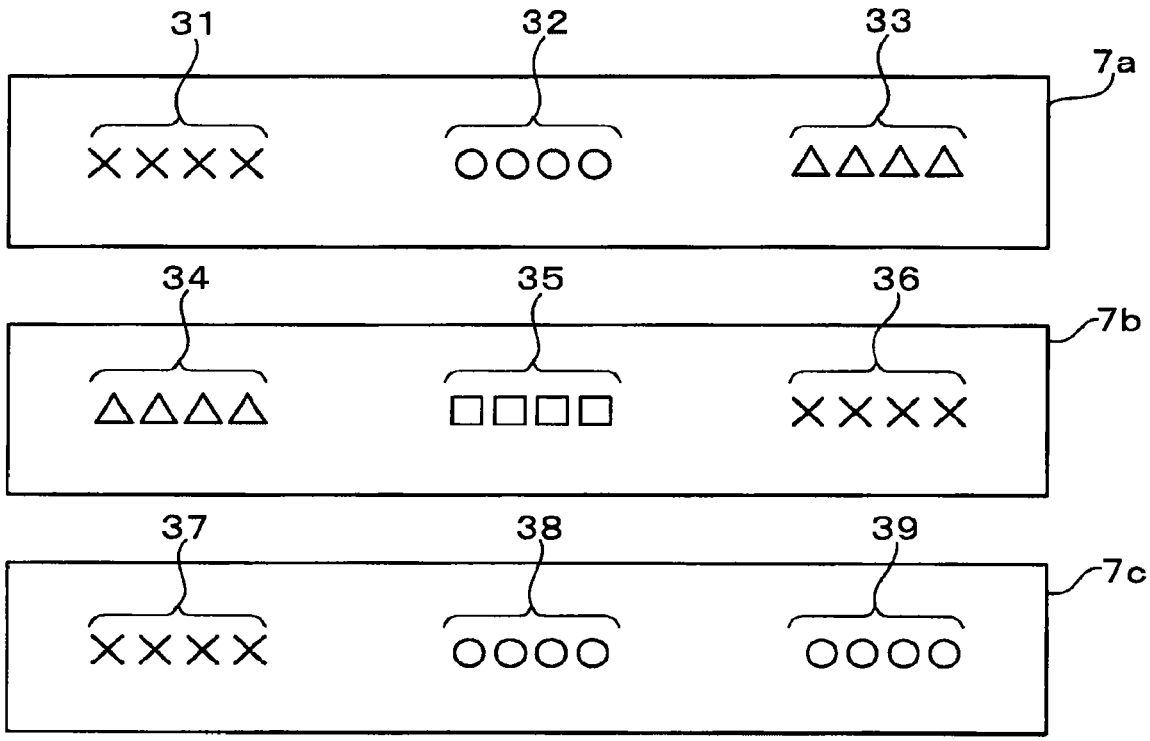
FIG. 4 is an exemplary diagram of an image to be displayed on a screen according to an embodiment of the present invention.

FIG. 4 is an exemplary diagram showing examples of images to be displayed on the screens 7*a*, 7*b*, and 7*c*. As shown in FIG. 4, an image 31 of "xxxx", an image 32 of "OOOO", and an image 33 of "ΔΔΔΔ" are displayed on the upper screen 7*a*. An image 34 of "ΔΔΔΔ", an image 35 of "□□□□", and an image 36 of "xxxx" are displayed on the middle screen 7*b*. An image 37 of "xxxx", an image 38 of "OOOO", and an image 39 of "OOOO" are displayed on the lower screen 7*c*. These images are, for example, merchandise information such as name, price, and so on of articles 4 displayed on the display shelves, and/or POP advertising of the articles 4.

Therefore, with the display shelf system 100 according to this embodiment of the present invention, it is possible to display, on the screens 7*a*, 7*b* and 7*c*, merchandise information and POP advertising related to the articles 4 displayed at the placing spaces 5*a*, 5*b*, and 5*c*.

Figure 7:
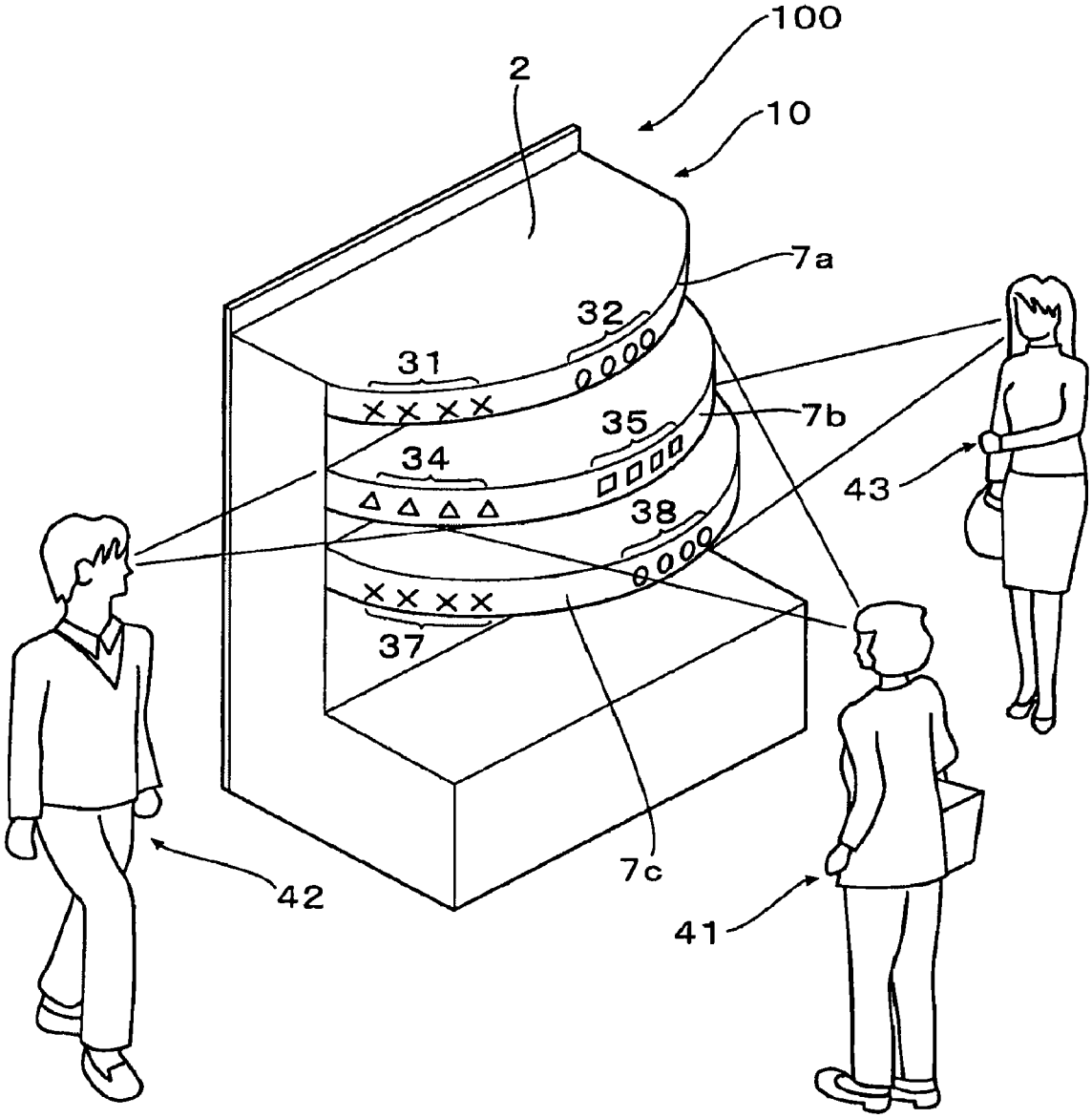
FIG. 7 is an exemplary diagram showing visibility of a display shelf according to an embodiment of the present invention.

Moreover, as shown in FIG. 7, with the structure described above, the screens 7*a*, 7*b*, and 7*c* are easily viewable by a viewer 42 and a viewer 43 who are positioned to the side of the display shelf 10 (are positioned in lateral directions with respect to the front of the display shelf 10), as well as by a viewer 41 who is in front of the display shelf 10, because the central regions of the screens extend forward farther than the sides thereof, whereby laterally-facing displays are formed. This structure enables the appealing effect of the display shelf 10 to be enhanced. The computer 300 is described above as being located away from the display shelf 10, for example in a stock room or back room 310 or another area away from the sales floor of the store. As a modification of the embodiment described above, the computer 300 can be located inside the display shelf 10. In this case, the contents data can be stored in the built-in computer 300. Additionally, the image displayed by the projector 200 under the control of the computer 300 in the display shelf 10 can be controlled by an external computer (not shown).

In addition, all of the screens 7*a*, 7*b*, and 7*c* are described above as being curved screens that include the laterally-facing displays. As another modification of the embodiment described above, one or more of the screens 7*a*, 7*b*, and 7*c* may have the structure described above, including the laterally-facing displays, and the other screen or screens may be flat displays.

Still further, the screens 7*a*, 7*b*, and 7*c* are described above as being wholly arc-shaped screens. As another modification of the embodiment described above, the laterally-facing displays can be formed in part of the screens 7*a*, 7*b*, and 7*c*.

Yet still further, the screens 7*a*, 7*b*, and 7*c* are described above as being disposed above the placing tables 6*a*, 6*b*, and 6*c* respectively. As another modification of the embodiment described above, the screens 7*a*, 7*b*, and 7*c* can be disposed below the placing tables 6*a*, 6*b* and 6*c*, respectively.

Other embodiments of the display shelf 10 according to the present invention are described below with reference to FIG. 8. Each of a FIGS. 8A to 8G shows a single screen according to a respective different embodiment of the present invention.

The structures of the display shelf 10 according to these embodiments are the same as the structure of the display shelf 10 according to the embodiment described above, except for the shape of the screens thereof.

Figure 8A:
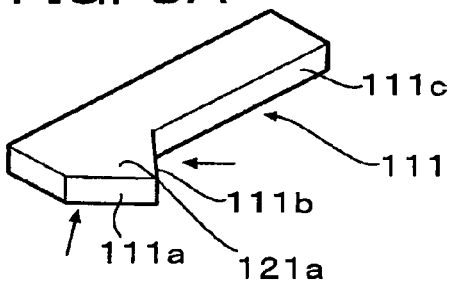
FIGS. 8A-8G are exemplary diagrams showing display shelves according to other embodiments of the present invention.

In the embodiment shown in FIG. 8A, the display shelf 10 has a screen 111, which includes a flat screen 111*c* and a projecting part 121*a* formed at one end of the screen 111. The flat screen 111*c* faces the front. At respective sides of the projecting part 121*a*, a flat screen 111*a* and a flat screen 111*b* are formed as laterally-facing displays. The flat screens 111*a* and 111*b* are inclined away from the front of the display shelf 10 and toward the lateral sides (toward lateral directions with respect to the front) of the display shelf 10, respectively. Thus, the screen 111 has a pair of laterally-facing displays.

With the display shelf 10 according to this embodiment of the present invention, images displayed on the flat screens 111*a* and 111*b* are easily viewable from the lateral directions (indicated by arrows in FIG. 8A), and an image displayed on the screen 111*c* is easily viewable from the front. This structure enables the appealing effect of the display shelf 10 to be enhanced.

Figure 8B:
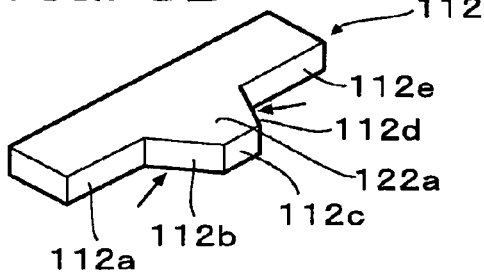

In the embodiment shown in FIG. 8B, the display shelf 10 has a screen 112, which includes a projecting part 122*a* formed at the central region of the screen 112. At respective sides of the projecting part 122*a*, a flat screen 112*b* and a flat screen 112*d* are formed as laterally-facing displays. The flat screens 112*b* and 112*d* are inclined away from the front of the display shelf 10 and toward the lateral sides (toward lateral directions with respect to the front) of the display shelf 10, respectively. At the ends of the screen 112, a flat screen 112*a* and a flat screen 112*e* are formed, respectively. The flat screen 112*a* and the flat screen 112*e* face the front. At the crown (anterior-most portion) of the projecting part 112*a*, a front-facing flat screen 112*c* is formed.

With the display shelf 10 according to this embodiment of the present invention, images displayed on the flat screens 112*b* and 112*d* are easily viewable from the lateral directions (indicated by arrows in FIG. 8B), and images displayed on the flat screens 112*a*, 112*c*, and 112*e* are easily viewable from the front. This structure enables the appealing effect of the display shelf 10 to be enhanced.

Figure 8C:
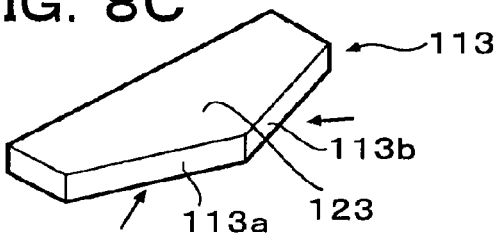

In the embodiment shown in FIG. 8C, the display shelf 10 has a screen 113, which includes a projecting part 123 formed at the central region of the screen 113. At respective sides of the projecting part 123, a flat screen 113*a* and a flat screen 113*b* are formed as laterally-facing displays. The flat screens 113*a* and 113*b* are gently-inclined away from the front of the display shelf 10 and toward the lateral sides (toward lateral directions with respect to the front) of the display shelf 10, respectively.

With the display shelf 10 according to this embodiment of the present invention, images displayed on the flat screens 113*a* and 113*b* are easily viewable from the lateral directions (indicated by arrows in FIG. 8C), as well as from the front. This structure enables the appealing effect of the display shelf 10 to be enhanced.

Figure 8D:
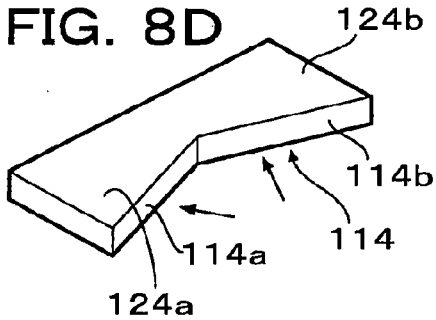

In the embodiment shown in FIG. 8D, the display shelf 10 has a screen 114, which includes a projecting part 124*a* and a projecting part 124*b*. The projecting parts 124*a* and 124*b* are formed at respective ends of the screen 114. A flat screen 114*a* and a flat screen 114*b* are formed as laterally-facing displays between the projecting parts 124*a* and 124*b*. The flat screen 114*a* is gently-inclined from the central region of the screen 114 toward the projecting part 124*a*. The flat screen 114*b* is gently-inclined from the central region of the screen 114 toward the projecting part 124*b*.

With the display shelf 10 according to this embodiment of the present invention, images displayed on the flat screens 114*a* and 114*b* are easily viewable from the lateral directions (indicated by arrows in FIG. 8D), as well as from the front. This structure enables the appealing effect of the display shelf 10 to be enhanced.

Figure 8E:
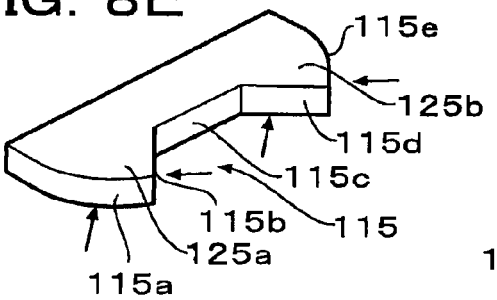

In the embodiment shown in FIG. 8E, the display shelf 10 has a screen 115, which includes a projecting part 125*a* and a projecting part 125*b*. The projecting parts 125*a* and 125*b* are formed at respective ends of the screen 115. At respective sides of the projecting part 125*a*, a curved screen 115*a* and a flat screen 115*b* are formed as laterally-facing displays. At respective sides of the projecting part 125*b*, a flat screen 115*d* and a curved screen 115*e* are formed as laterally-facing displays. The curved screens 115*a* and 115*e* are inclined away from the front of the display shelf 10 and are convex toward the lateral directions with respect to the front of the display shelf 10, respectively. The flat screens 115*b* and 115*d* are inclined away from the front of the display shelf 10 and toward the lateral sides (toward lateral directions with respect to the front) of the display shelf 10, respectively. Thus, the screen 115 has four laterally-facing displays. Between the projecting parts 125*a* and 125*b*, a front-facing flat screen 115*c* is formed.

With the display shelf 10 according to this embodiment of the present invention, images which are displayed on the curved screen 115*a*, the flat screen 115*b*, the flat screen 115*d*, and the curved screen 115*e* are easily viewable from the lateral directions (indicated by arrows in FIG. 8E), and an image displayed on the flat screen 115*c* is easily viewable from the front. This structure enables the appealing effect of the display shelf 10 to be enhanced.

Figure 8F:
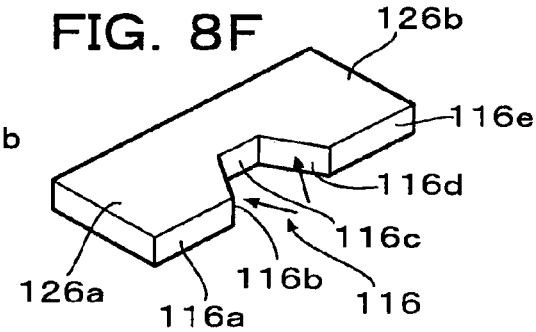

In the embodiment shown in FIG. 8F, the display shelf 10 has a screen 116, which includes a projecting part 126*a* and a projecting part 126*b*. The projecting parts 126*a* and 126*b* are formed at respective ends of the screen 116. On the front ends of the projecting parts 126*a* and 126*b*, front-facing flat screens 116*a* and 116*e* are formed, respectively. On the inner side of the projecting part 126*a*, a flat screen 116*b* is formed as a laterally-facing display. On the inner side of the projecting part 126*b*, a flat screen 116*d* is formed as a laterally-facing display. The flat screens 116*b* and 116*d* are inclined away from the front of the display shelf 10 and toward the lateral sides (toward lateral directions with respect to the front) of the display shelf 10, respectively. And between the projecting parts 126*a* and 126*b*, a front-facing flat screen 116*c* is formed.

With the display shelf 10 according to this embodiment of the present invention, images displayed on the flat screens 116*b* and 116*d* are easily viewable from the lateral directions (indicated by arrows in FIG. 8F), and images displayed on the flat screens 116*a*, 116*c*, and 116*e* are easily viewable from the front. This structure enables the appealing effect of the display shelf 10 to be enhanced.

Figure 8G:
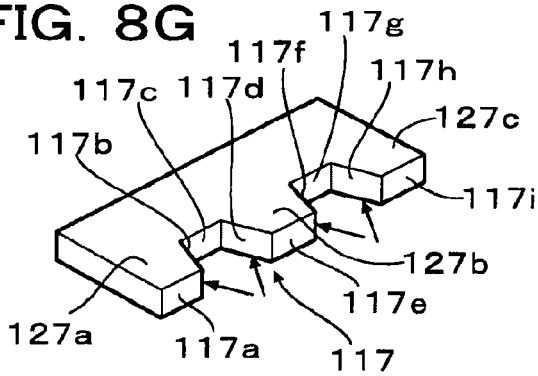

In the embodiment shown in FIG. 8G, the display shelf 10 has a screen 117 which includes a projecting part 127*a*, a projecting part 127*b*, and a projecting part 127*c*. The projecting parts 127*a* and 127*c* are disposed at respective ends of the screen 117. The projecting part 127*b* is disposed at the central region of the screen 117. At the front ends of the projecting parts 127*a*, 127*b*, and 127*c*, front-facing flat screens 117*a*, 117*e*, and 117*i* are formed, respectively. On the inner side of the projecting part 127*a*, a flat screen 117*b* is formed as a laterally-facing display. On the inner side of the projecting part 127*c*, a flat screen 117*h* is formed as a laterally-facing display. On respective sides of the projecting part 127*b*, a flat screen 117*d* and a flat screen 117*f* are formed as laterally-facing displays. Each of the flat screens 117*b*, 117*d*, 117*f*, and 117*h* is inclined away from the front of the display shelf 10 and toward one of the lateral sides (toward one of the lateral directions with respect to the front) of the display shelf 10. Between the projecting parts 127*a* and 127*b*, a front-facing flat screen 117*c* is formed. Between the projecting parts 127*b* and 127*c*, a front-facing flat screen 117*g* is formed.

With the display shelf 10 according to this embodiment of the present invention, images displayed on the flat screens 117*b*, 117*d*, 117*f*, and 117*h* are easily viewable from the lateral directions (indicated by arrows in FIG. 8G), and images displayed on the flat screens 117*a*, 117*c*, 117*e*, 117*g*, and 117*i* are easily viewable from the front. This structure enables the appealing effect of the display shelf 10 to be enhanced.

Obviously, numerous modifications and variations of the present invention are possible in light of the above teachings. It is therefore to be understood that within the scope of the appended claims, the invention may be practiced otherwise than as specifically described herein.

What is claimed is:

1. A display shelf, comprising:

a plurality of placing tables arranged in a vertical direction, each of which is adapted to have an article placed thereon;

a projector placing portion which is adapted to support a projector;

a plurality of transmission-type screens, each of which is arranged with a corresponding one of the placing tables, and is disposed above or below the corresponding one of the placing tables;

a housing which has a space; and a plurality of mirrors arranged in the space which reflect respective portions of a projector image projected by the projector toward the transmission-type screens, wherein at least one of the transmission-type screens includes a plurality of projecting parts at either end of the at least one of the transmission-type screens, the projecting parts extending toward a front direction of the display shelf, and laterally-facing displays which have respectively smooth slopes and extend toward either end from a center of the at least one of the transmission-type screens and are inclined to face toward lateral directions with respect to a front of the display shelf.

2. A display shelf according to claim 1, wherein the laterally-facing display includes a curved surface.

3. A display shelf according to claim 1, wherein the laterally-facing display includes a flat surface.

4. A display shelf according to claim 1, wherein laterally-facing display includes a curved surface and a flat surface.

5. A display shelf according to claim 1, further comprising the projector, which is supported on the projector placing portion.

6. A display shelf according to claim 1, wherein the transmission-type screen is positioned above the placing table.

7. A display shelf according to claim 1, wherein the transmission-type screen is positioned below the placing table.

8. A display shelf according to claim 1, wherein the light guide includes: a housing forming a space for leading the projector image projected from the projector; and an optical system which is placed in the space and reflects the projector image projected from the projector toward the rear side of the transmission-type screen.

9. A display shelf according to claim 1, wherein the space includes:

a lower space;

a vertical space, which is positioned behind the lower space so as to communicate with the lower space, and which extends vertically upward; and a plurality of horizontal spaces which are formed in front of and communicate with the vertical space;

wherein the projector placing portion is located inside the lower space;

wherein at least one of the placing tables defines a portion of at least one of the horizontal spaces;

wherein one of the transmission-type screens is arranged at a front end of each of the horizontal spaces; and wherein one of the mirrors is disposed at a level of each of the horizontal spaces.

10. A display shelf according to claim 1, further comprising:

A light guide adapted to lead an image onto a rear side of the transmission-type screen.

* * * * *